US008459409B2

(12) United States Patent
Wiser

(10) Patent No.: US 8,459,409 B2
(45) Date of Patent: Jun. 11, 2013

(54) POST ANCHOR EXTENSION FOR A HORIZONTAL LIFELINE SYSTEM

(75) Inventor: Timothy James Wiser, Hartwell, GA (US)

(73) Assignee: United Forming, Inc., Austell, GA (US)

( * ) Notice: Subject to any disclaimer, the term of this patent is extended or adjusted under 35 U.S.C. 154(b) by 325 days.

(21) Appl. No.: 12/824,647

(22) Filed: Jun. 28, 2010

(65) Prior Publication Data

US 2011/0315474 A1 Dec. 29, 2011

(51) Int. Cl.
*A62B 1/00* (2006.01)

(52) U.S. Cl.
USPC ..... 182/3; 182/113

(58) Field of Classification Search
USPC . 182/113, 3; 256/65.14, DIG. 5; 52/296–298, 52/848, 169.13, 170, 295
See application file for complete search history.

(56) References Cited

U.S. PATENT DOCUMENTS

| | | | | | |
|---|---|---|---|---|---|
| 1,329,026 | A | | 1/1920 | Synder | |
| 2,211,283 | A | | 8/1940 | Mercer | |
| 2,780,440 | A | * | 2/1957 | Krieger | 256/21 |
| 3,628,296 | A | * | 12/1971 | Henry | 52/98 |
| 3,740,022 | A | * | 6/1973 | DiGiovanni | 256/24 |
| 3,756,568 | A | * | 9/1973 | Mocny et al. | 256/59 |
| 3,920,221 | A | * | 11/1975 | Berry et al. | 256/59 |
| 4,240,766 | A | * | 12/1980 | Smith et al. | 404/10 |
| 4,453,354 | A | | 6/1984 | Harbeke | |
| 4,644,713 | A | * | 2/1987 | Lehman | 52/165 |
| 5,152,507 | A | * | 10/1992 | Lee | 256/13.1 |
| 5,398,478 | A | | 3/1995 | Gordin et al. | |
| 5,586,423 | A | * | 12/1996 | Mullen | 52/653.2 |
| 5,603,389 | A | | 2/1997 | Zemon | |
| 5,632,464 | A | * | 5/1997 | Aberle | 248/530 |
| 5,913,778 | A | * | 6/1999 | Hying et al. | 52/40 |
| 6,038,829 | A | | 3/2000 | Franks | |
| 6,161,769 | A | | 12/2000 | Kircher et al. | |
| 6,173,809 | B1 | * | 1/2001 | Cole et al. | 182/3 |
| 6,202,369 | B1 | | 3/2001 | Partee et al. | |
| 6,350,093 | B1 | | 2/2002 | Peterson et al. | |
| 6,523,808 | B1 | * | 2/2003 | Lehmann | 256/65.14 |
| 6,691,826 | B1 | * | 2/2004 | Dean | 182/113 |
| 7,032,710 | B2 | | 4/2006 | Anderson et al. | |
| 7,159,473 | B1 | | 1/2007 | Bowers | |
| 2002/0189901 | A1 | * | 12/2002 | Cole | 182/113 |
| 2003/0042072 | A1 | * | 3/2003 | Murray | 182/45 |
| 2003/0159883 | A1 | * | 8/2003 | Carson | 182/113 |
| 2003/0173149 | A1 | | 9/2003 | Anderson et al. | |

(Continued)

FOREIGN PATENT DOCUMENTS

| | | |
|---|---|---|
| WO | 03080186 | 10/2003 |
| WO | 2007002335 | 1/2007 |
| WO | 2008052345 | 5/2008 |
| WO | 2009044405 | 4/2009 |

*Primary Examiner* — Alvin Chin Shue
*Assistant Examiner* — Daniel Cahn
(74) *Attorney, Agent, or Firm* — Taylor English Duma, LLP

(57) ABSTRACT

Personal fall arrest systems, such as horizontal lifeline systems, are described in the present disclosure. Typically, posts are inserted in a structure to support a cable used in the horizontal lifeline systems. According to the implementations of post anchor extension described herein, the present disclosure describes a post anchor extension having a base component configured to be inserted within a foundation element of a structure in a fall hazard area of the structure. The post anchor extension also includes a post sleeve configured to be fixedly connected relative to the base component. The post sleeve is further configured to support a post of a horizontal lifeline system.

10 Claims, 15 Drawing Sheets

U.S. PATENT DOCUMENTS

2006/0239764 A1* 10/2006 Salman ..... 403/2
2006/0289233 A1 12/2006 Flaherty
2008/0277557 A1 11/2008 Vetesnik et al.
2009/0188751 A1 7/2009 Gilliam

* cited by examiner

POST ANCHOR EXTENSION FOR A HORIZONTAL LIFELINE SYSTEM

TECHNICAL FIELD

The present disclosure generally relates to horizontal lifelines, and more particularly relates to stanchions used with horizontal lifeline systems.

BACKGROUND

Construction workers are often exposed to dangerous conditions that can result in serious injury or even death. In addition to working with heavy machinery and powerful equipment, workers may be required to position themselves at significant heights above the ground, which can pose a risk of falling. Because there are often openings in floors and walls of buildings that are under construction or in repair, it is critical to the safety of the workers to install fall protection systems. Temporary guardrails and other type of guarding systems are often installed to prevent the occurrence of falls.

However, in the event that a worker does fall, back-up fall arrest systems are often used. For example, safety nets may be placed below fall hazard areas to stop a person's fall with relatively little injury. Another type of fall protection is a personal fall arrest system or lifeline system. The lifeline system (e.g., a horizontal lifeline system) usually contains a cable securely fastened to the building or other secure structure in a fall hazard environment. Also, a lifeline or lanyard is attached from the cable to a harness that is worn by a person operating in the fall hazard location. If a worker were to fall over an edge or through a hole while attached to the lifeline system, the worker would only fall a distance equal to about the length of the lifeline. Therefore, the effectiveness of these and other fall protection systems can have a large impact on the lives of people working in such fall hazard environments.

SUMMARY

The present disclosure describes personal fall arrest systems such as horizontal lifeline (HLL) systems. According to one of many implementations of HLL systems, the present disclosure describes a HLL system having at least two stanchions installed in a fall hazard area of a structure. Each stanchion contains a post supported by a post anchor extension, where each post anchor extension is configured to extend the height of the positioning of the post. The HLL system also includes a cable connected between the stanchions and a lifeline connected at one end to a harness worn by a person in the fall hazard area and moveably linked at the other end to the cable.

According to one of many implementations of stanchions used in the assembly of a horizontal lifeline system, the present disclosure describes a stanchion comprising a post anchor extension and a post supported by the post anchor extension. The post anchor extension is configured to extend the height at which the post is positioned.

The present disclosure also describes many implementations of a post anchor extension, some implementations comprising a base component configured to be inserted within a foundation element of a structure in a fall hazard area of the structure. The post anchor extension also includes a post sleeve configured to be fixedly connected relative to the base component. The post sleeve further may be configured to support a post of a horizontal lifeline system.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure and are not necessarily drawn to scale. Corresponding features and components throughout the figures may be designated by matching reference characters for the sake of consistency and clarity.

DETAILED DESCRIPTION

The present disclosure describes personal fall arrest systems, such as horizontal lifeline (HLL) systems. HLL systems typically include multiple posts securely supported within holes in a floor of a building or mounted to any secure structure in a fall hazard area. A cable is connected to two or more of these posts. Workers in the fall hazard areas may wear a body harness that is attached to one end of a lifeline, the other end of which is moveably connected to the cable. The length of the lifeline may allow the worker to move around freely but still be short enough such that in the event of a fall, the worker does not land on anything below. The length of the lifeline is often not a factor in the safety of the worker. However, if a worker is located on one of the lower floors of a building or on any floor having objects a short distance below the floor, the length of the lifeline may not be short enough to stop the worker's fall before hitting the ground or other objects below.

The systems described in the present disclosure are configured to extend the height of the posts of the HLL systems, which thereby extends the height of the cable. One advantage of this height extension is to reduce the overall fall distance if a worker were to fall. By increasing or raising the elevation of the anchor, the fall clearance height issues are minimized.

The post anchor extensions described herein may be inserted in the floor of a building and provide support for the posts. Although various implementations are described for post anchor extensions configured to be inserted into the floor of a building, the post anchor extensions may also be inserted in or connected to any receptacle in or component of any secure structure where fall protection is needed. In addition, the various implementations of the post anchor extensions are described as being designed to extend the height at which a post of an HLL is positioned above the surface of the floor. The post anchor extensions may also be used to extend the placement height of any type of vertically oriented post, pole, pipe, or other component.

Furthermore, the various implementations of the post anchor extensions are described with respect to fall hazard areas that are elevated heights above ground level, other implementations may include using the post anchor extensions in other environments, such as underground mines, quarries, caves, cliffs, or other areas that may pose a falling risk.

The present disclosure further describes a handle extension that is configured to provide an extra level of security for a person in a fall hazard area. Other features and advantages will be apparent to one of ordinary skill in the art upon consideration of the general principles described herein, and all such features and advantages are intended to be included in the present disclosure.

Figure 1:
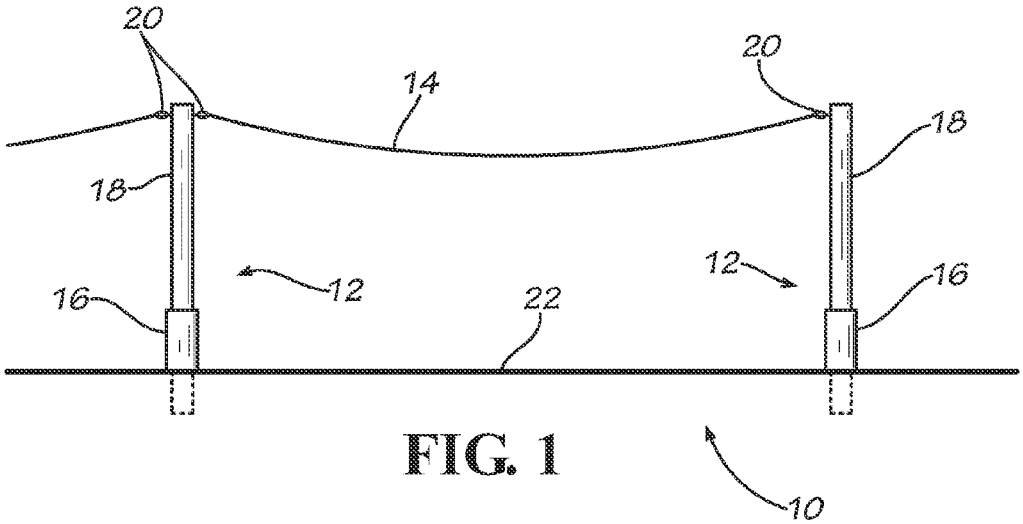
FIG. 1 is a diagram of a horizontal lifeline system according to various implementations of the present disclosure.

FIG. 1 is a diagram showing a side view of an embodiment of a horizontal lifeline (HLL) system 10 according to various implementations of the present disclosure. Generally, the HLL system 10 includes at least two stanchions 12 and a cable 14 connected to top sections of the stanchions 12. In some embodiments, the cable 14 may consist of galvanized independent wire rope core (IWRC) steel cable with a right regular lay (RRL). End stanchions 12 may be configured to connect to the ends of the cable 14 depending on the particular design of the HLL system 10. The HLL system 10 may also include any number of additional stanchions 12 that support the cable 14 at intermediate locations along its length. The stanchions 12 include a post anchor extension 16, a post 18, and one or more cable support systems 20. The post 18 may consist of aluminum or steel, and may have an outside diameter of about 4 inches, 4.5 inches, or other common sizes.

The post anchor extensions 16 are configured to be fixedly connected to a portion of a structure 22, such as a floor of a building, a roof-top, a bridge, or other structure having an elevated work area. In some embodiments, a bottom portion of the post anchor extensions 16 may be supported within a cylindrical opening in a concrete floor. The posts 18 are configured to be mounted in an open end of a top portion of the post anchor extensions 16. A top end of the posts 18 may be configured to securely hold the cable support systems 20, heightened by the length of extension of the post anchor extensions. The cable support systems 20 may be mounted on the posts 18 by nuts and bolts, by a ratchet support, or by any other suitable mounting devices.

Figure 2A:
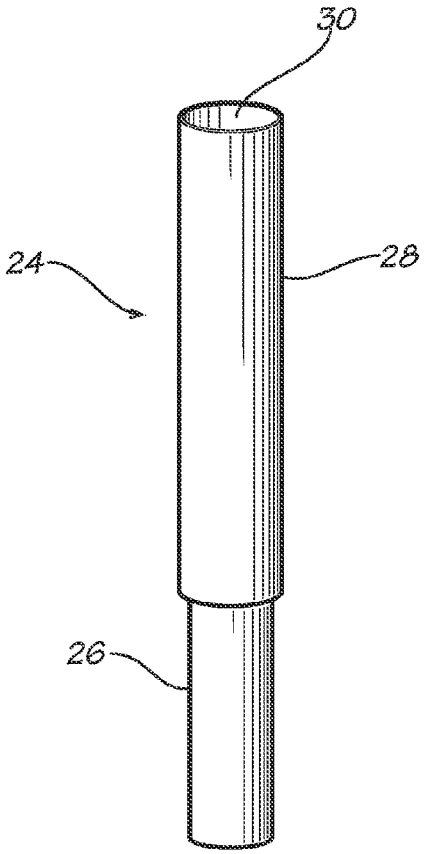
FIGS. 2A-2F are diagrams of a first embodiment of the post anchor extension shown in FIG. 1, according to various implementations.
Figure 2B:
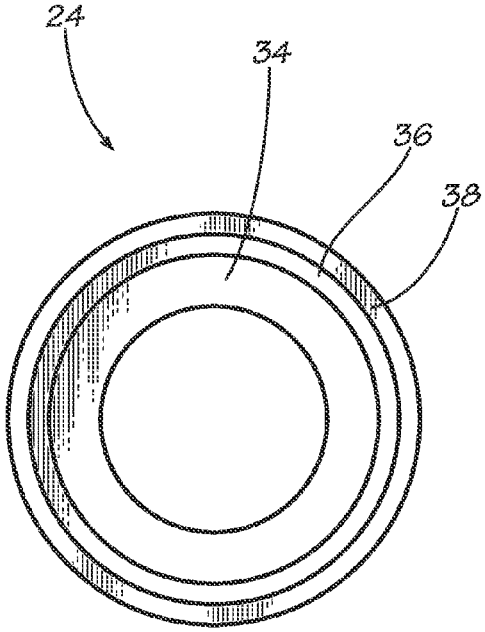
Figure 2C:
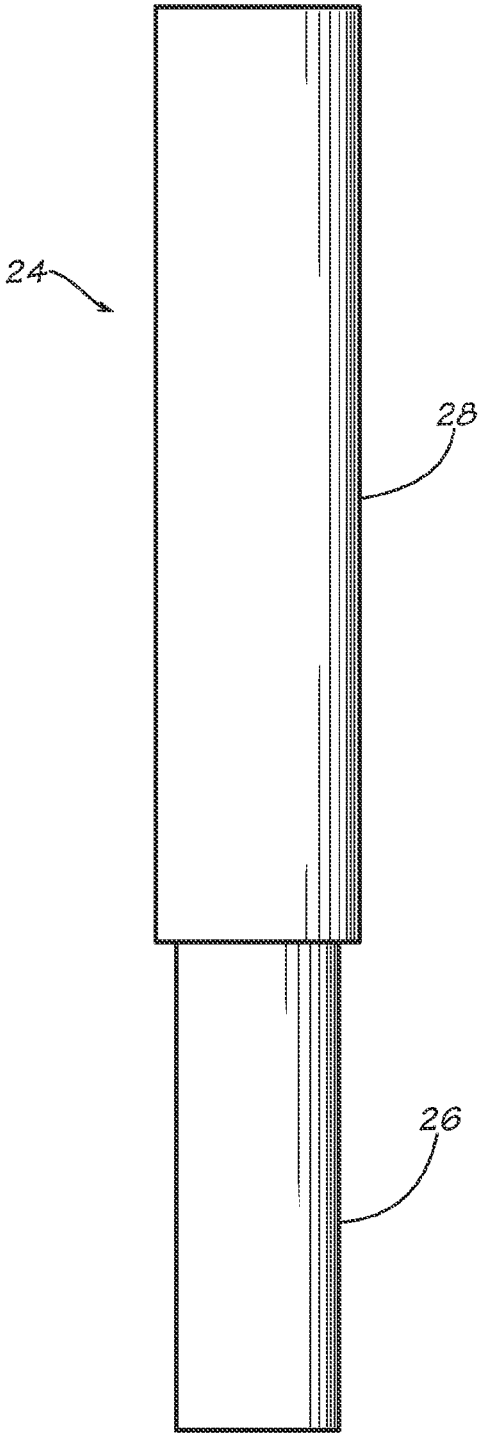
Figure 2D:
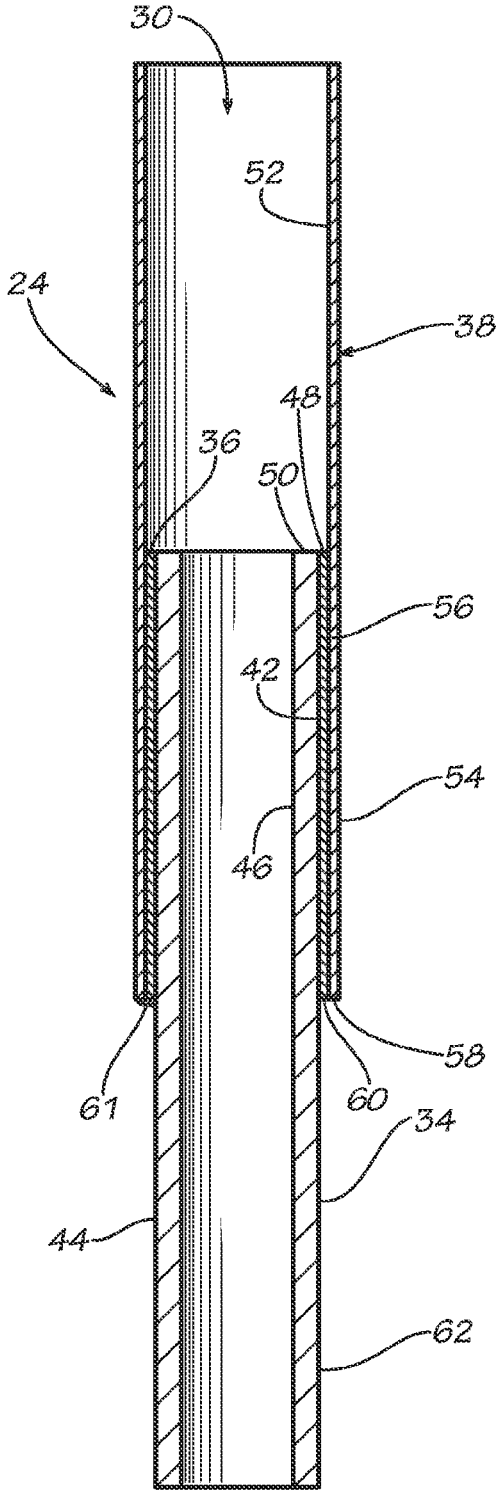
Figure 2E:
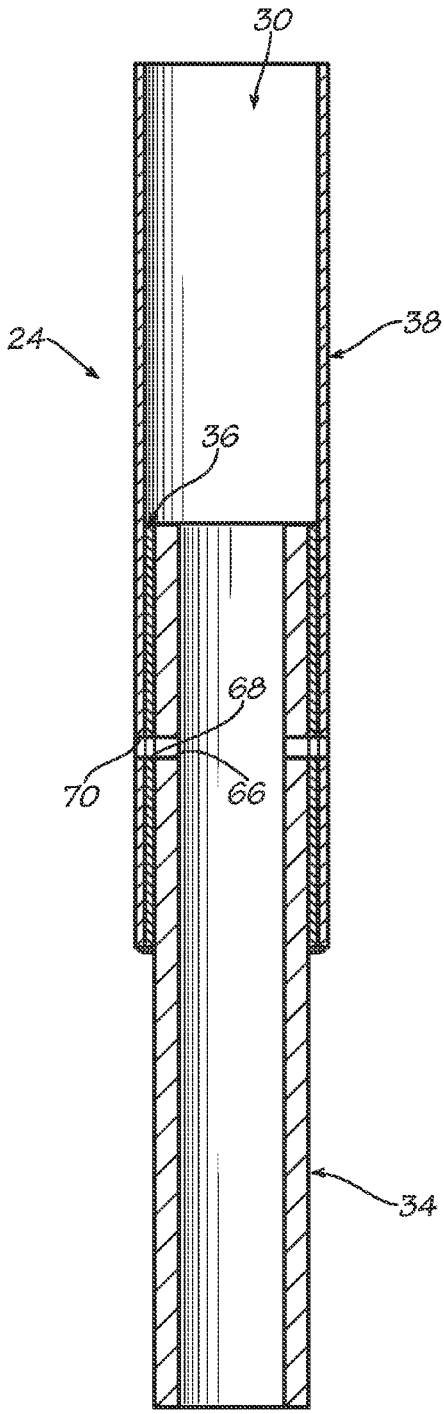
Figure 2F:
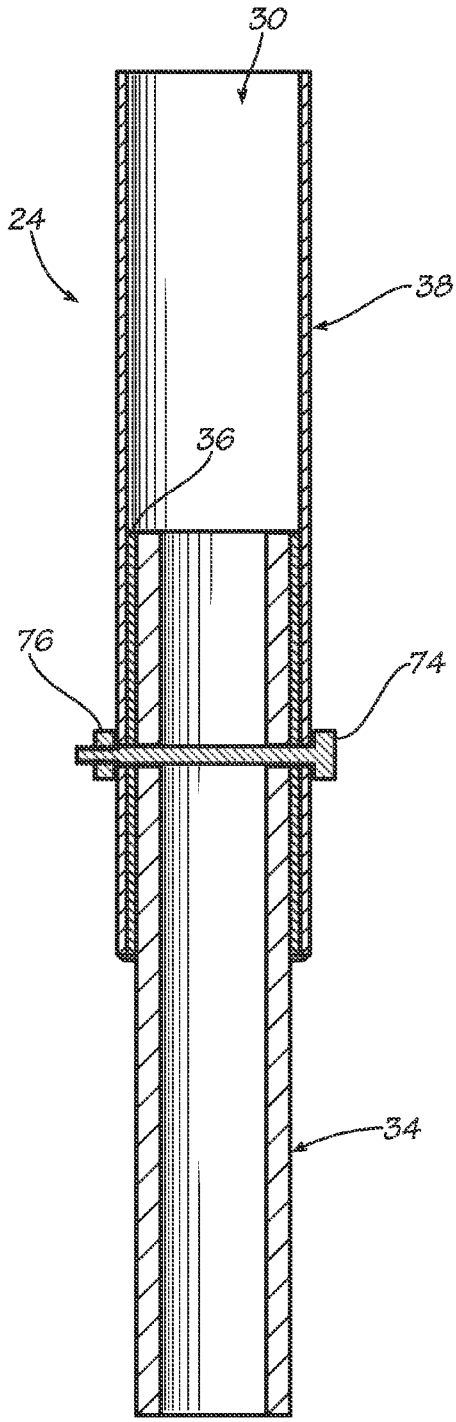

FIGS. 2A-2F are diagrams illustrating a first embodiment of a post anchor extension 24 according to various implementations. The post anchor extension 24 of FIGS. 2A-2F may represent some embodiments of the post anchor extensions 16 shown in FIG. 1. To illustrate the various features of the post anchor extension 24, FIG. 2A shows a perspective view, FIG. 2B shows a top view, FIG. 2C shows a side view, and FIG. 2D shows a cut-away side view. Also, FIGS. 2E and 2F show cut-away side views of implementations of the post anchor extension 24 having alternative means for connecting the elements of the post anchor extension 24 together.

As shown in FIGS. 2A and 2C, the post anchor extension 24 includes a bottom portion 26 that is inserted into a hole or receptacle that may be configured to support a conventional HLL post. The post anchor extension 24 also includes a top portion 28 that is configured to sit upright above the hole when the bottom portion 26 is inserted. The top portion 28 includes an open end 30 that is configured to receive a conventional HLL post.

As shown in FIGS. 2B and 2D, the post anchor extension 24 includes a base component 34, a spacer 36, and a post sleeve 38. According to various implementations, the post anchor extension 24 may be configured such that its entire length, when assembled, ranges from about 28 to 48 inches. In some embodiments, the base component 34 may have a length of about 23 inches; the spacer 36 may have a length of about 11 inches; and the post sleeve 38 may have a length of about 23 inches. With these dimensions and with the components overlapping 11 inches, the overall length may be about 35 inches.

As illustrated in FIG. 2D, the spacer 36 may be positioned such that its inside surface 42 is adjacent to an outside surface 44 of a top section 46 of the base component 34. Also, the spacer 36 may be positioned such that its top end 48 is even with a top end 50 of the base component 34. The post sleeve 38 may be positioned such that an inside surface 52 of a bottom section 54 of the post sleeve 38 is adjacent to an outside surface 56 of the spacer 36. Also, the post sleeve 38 may be positioned such that its bottom end 58 is even with a bottom end 60 of the spacer 36.

To hold the different elements together, the elements may be welded, such as with a tack weld 61 applied to an area where the elements are positioned near each other. In some embodiments, the tack weld 61 may be applied at two or more locations around the periphery of the outside surface 44 of the base component 34 at the respective bottom ends 60, 58 of the spacer 36 and post sleeve 38. According to other implementations, the tack weld 61 can be applied around the entire periphery of the base component 34. A bottom section 62 of the base component 34 may be inserted in a hole typically configured to receive a conventional post. The bottom ends 60, 58 of the spacer 36 and post sleeve 38 may rest upon the surface of the structure 22 (FIG. 1) around the hole. When the post anchor extension 24 is in place, a post may be inserted through the open end 30 of the post sleeve 38 until its bottom end rests upon the top ends 50, 48 of the base component 34 and spacer 36. With this arrangement, the post anchor extension 24 can extend the height of the positioning of the post above its normal positioning by the length of the base component 34, which in some embodiments is about 23 inches.

FIGS. 2E and 2F, according to various embodiments, illustrate an alternative means for connecting the three elements together, that is, by one or more sets of nuts and bolts inserted through holes in the elements. The base component 34 may include openings 66 in opposing walls of the base component 34. Also, the spacer 36 may include openings 68 and the post sleeve 38 may include openings 70. The openings may be aligned to allow a bolt 74 to be inserted through the elements to secure them together. The bolt 74 can be secured by a nut 76. According to various embodiments, additional bolts may be inserted through other openings in the elements for holding the elements together.

The outside diameter of the base component 34 may range from about three to six inches according to various embodiments. The wall thickness may be selected accordingly depending on the outside diameter. According to some implementations, the base component 34 may have an inside diameter of 2.728 inches and an outside diameter of 4.000 inches.

The spacer 36 may have an inside diameter of 4.026 inches and an outside diameter of 4.500 inches. The post sleeve 38 may have an inside diameter of 4.506 inches and an outside diameter of 5.000 inches. These dimensions may allow the three sections to fit together relatively firmly. The base component 34 may have a wall thickness of at least 0.5 inches. In some embodiments, the base component 34 may be a solid rod. Also, according to some embodiments, the post sleeve 38 may be configured to have a wall thickness in the range from about ⅜ths of an inch to ⅝ths of an inch.

Any or all of the components of the post anchor extension 24 may consist of steel that meets American Standard for Testing and Materials (ASTM) specifications for welded black and hot-dipped galvanized steel pipe. For example, any or all of the components may meet the steel specifications for ASTM A53 Grade B carbon steel alloy or other similar specifications. In other embodiments, any or all of the components may consist of other strength material and may have minimal tensile stress of at least 60 kilo-pounds per square inch (60 ksi) or 415 megapascals (415 MPa). The components may also have minimal tensile yield strength of at least 240 MPa (35 ksi). The material may be a structural steel with lightweight high-strength alloys (e.g., titanium). Other strength materials may be used that have the ability to sufficiently support an object (e.g., worker) falling from a certain height, depending on the particular application. In some embodiments, the spacer 36 may consist of polyvinyl chloride (PVC), such as standard dimension ratio 26 (SDR 26) PVC.

Figure 3A:
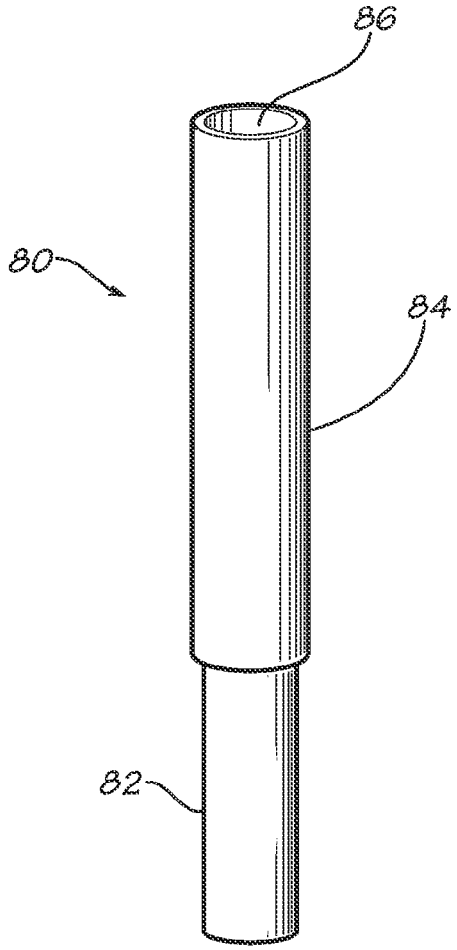
FIGS. 3A-3F are diagrams of a second embodiment of the post anchor extension shown in FIG. 1, according to various implementations.
Figure 3B:
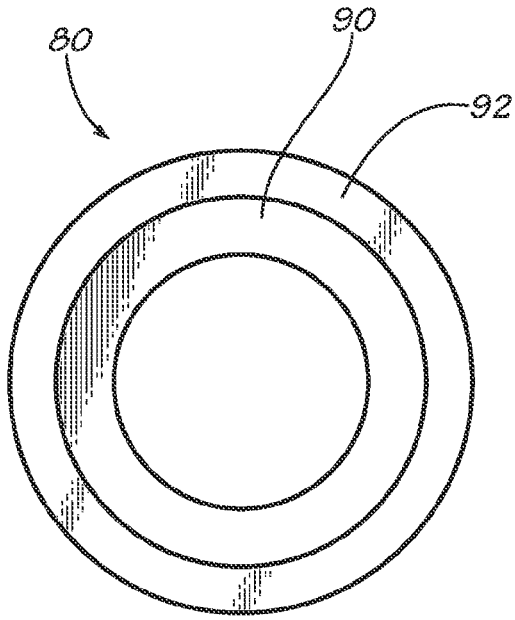
Figure 3C:
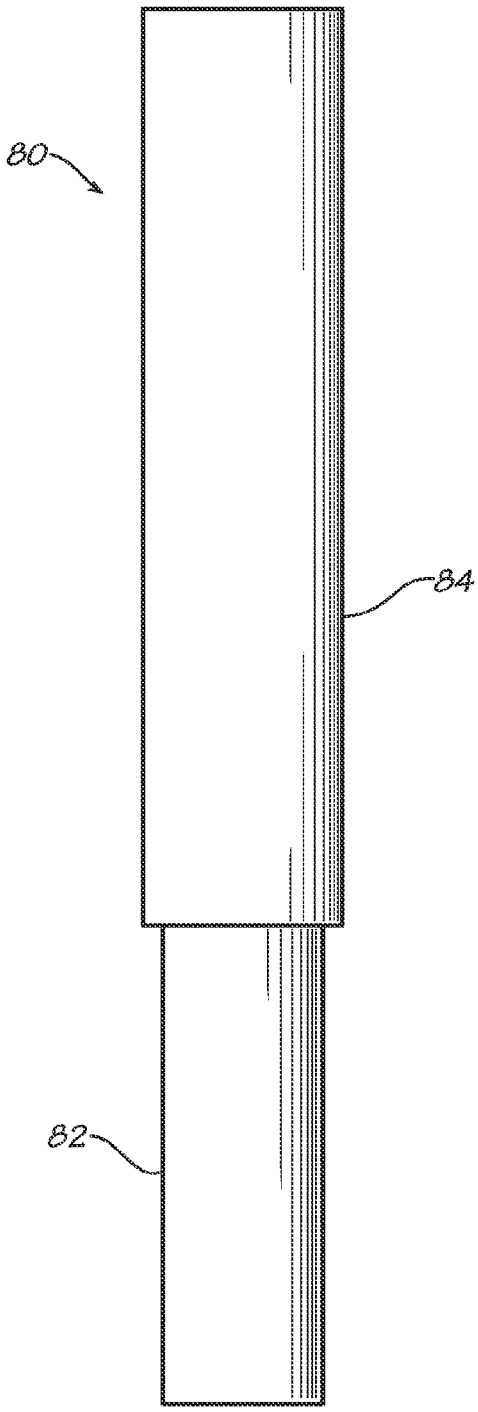
Figure 3D:
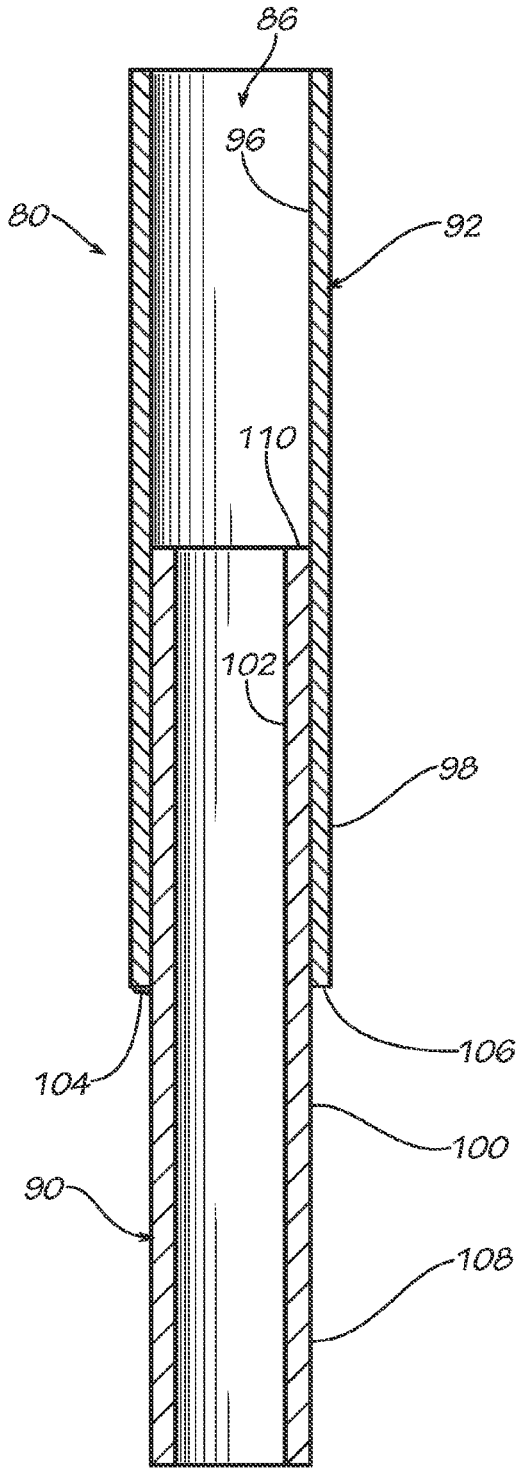
Figure 3E:
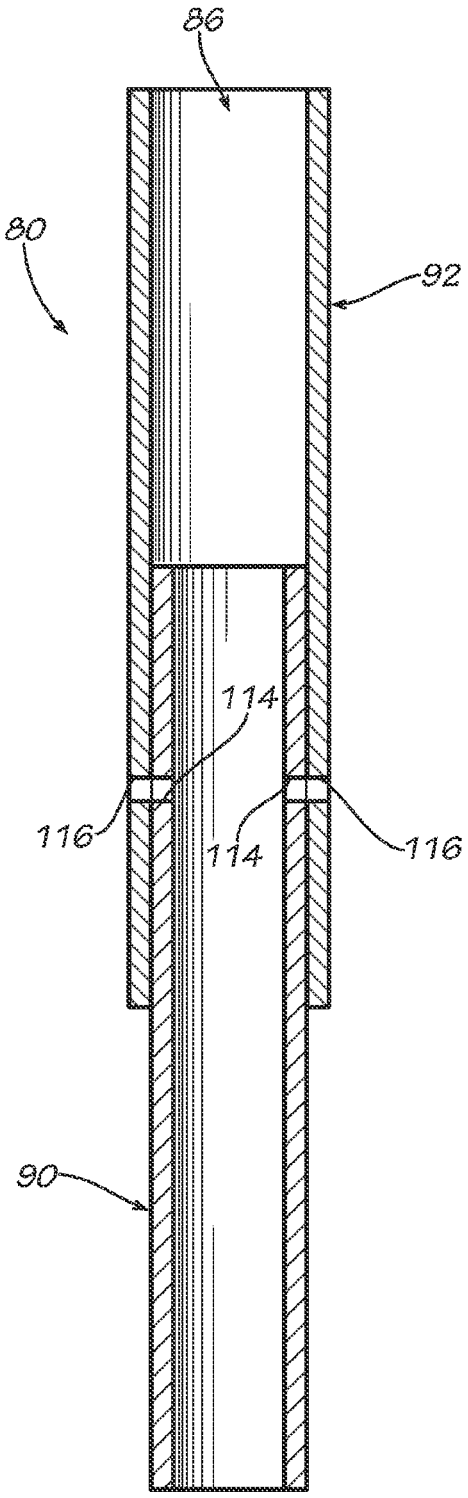
Figure 3F:
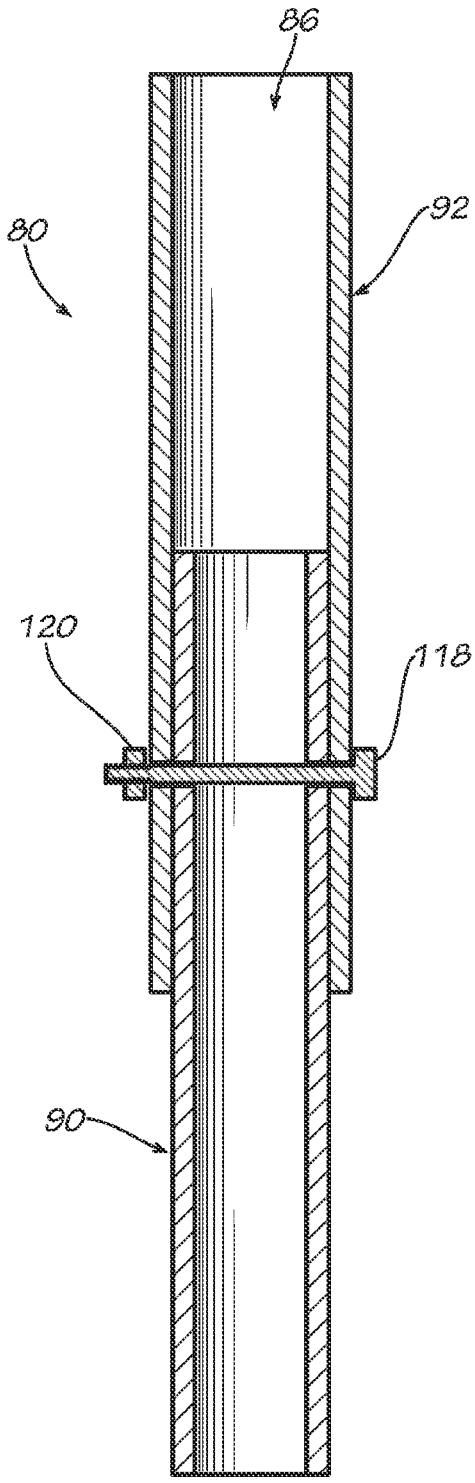

FIGS. 3A-3D are diagrams showing a second embodiment of a post anchor extension 80 according to various implementations and may be used for the post anchor extension 16 that is shown in FIG. 1. To illustrate the various features of the post anchor extension 80, FIG. 3A shows a perspective view, FIG. 3B shows a top view, FIG. 3C shows a side view, and FIG. 3D shows a cut-away side view. Also, FIGS. 3E and 3F show cut-away side views of implementations of the post anchor extension 80 having alternative means for connecting the elements of the post anchor extension 80 together.

As shown in FIGS. 3A and 3C, the post anchor extension 80 includes a bottom portion 82 that is inserted in a hole or receptacle that may be configured to support a conventional HLL post. The post anchor extension 80 also includes a top portion 84 that is configured to sit upright above the hole when the bottom portion 82 is inserted. The top portion 84 includes an open end 86 that is configured to receive a conventional HLL post.

As shown in FIGS. 3B and 3D, the post anchor extension 80 includes a base component 90 and a post sleeve 92. As opposed to the embodiments of FIGS. 2A-2F, this embodiment does not include a spacer between the base component 90 and the post sleeve 92. In some embodiments, both the base component 90 and post sleeve 92 may each have a length of about 23 inches. An inside surface 96 of a bottom section 98 of the post sleeve 92 may be positioned adjacent to an outside surface 100 of a top section 102 of the base component 90, wherein the two components may overlap by about 11 inches.

To hold the post sleeve 92 to the base component 90 in this embodiment, the elements may be welded, such as with a tack weld 104 applied to an accessible area where the elements are positioned adjacent to each other. In some embodiments, the tack weld 104 may be applied at two or more locations around the periphery of the base component 90 at a bottom end 106 of the post sleeve 92. According to other implementations, the tack weld 104 can be applied around the entire periphery of the base component 90.

A bottom section 108 of the base component 90 may be inserted in a hole or receptacle that may be configured to receive a post of a conventional HLL system. The bottom end 106 of the post sleeve 92 may rest upon the surface of the structure 22 (FIG. 1) around the hole. When the post anchor extension 80 is in place, a post may be inserted through the open end 86 of the post sleeve 92 until its bottom end rests upon a top end 110 of the base component 90. With this arrangement, the post anchor extension 80 can extend the height of the positioning of the post by the length of the base component 90, which may be about 23 inches.

According to various implementations, the base component 90 may have an inside diameter of 2.728 inches and an outside diameter of 4.000 inches. The post sleeve 92 may have an inside diameter of 4.026 inches and an outside diameter of 5.000 inches. These dimensions allow the components to fit firmly together.

FIGS. 3E and 3F are cut-away side views of an embodiment of the post anchor extension 80 in which the elements may be secured together by one or more sets of nuts and bolts connected through one or more holes in the two elements. In this embodiment, the base component 90 includes openings 114 on opposing walls thereof. Also, the post sleeve 92 includes openings 116 on opposing walls, substantially in line with the openings 114. When the openings 114 and 116 are aligned, a bolt 118 may be inserted through the openings 114 and 116 and may be secured by a nut 120. In the embodiment of FIGS. 3E and 3F, the tack weld 104 may be omitted.

Figure 4A:
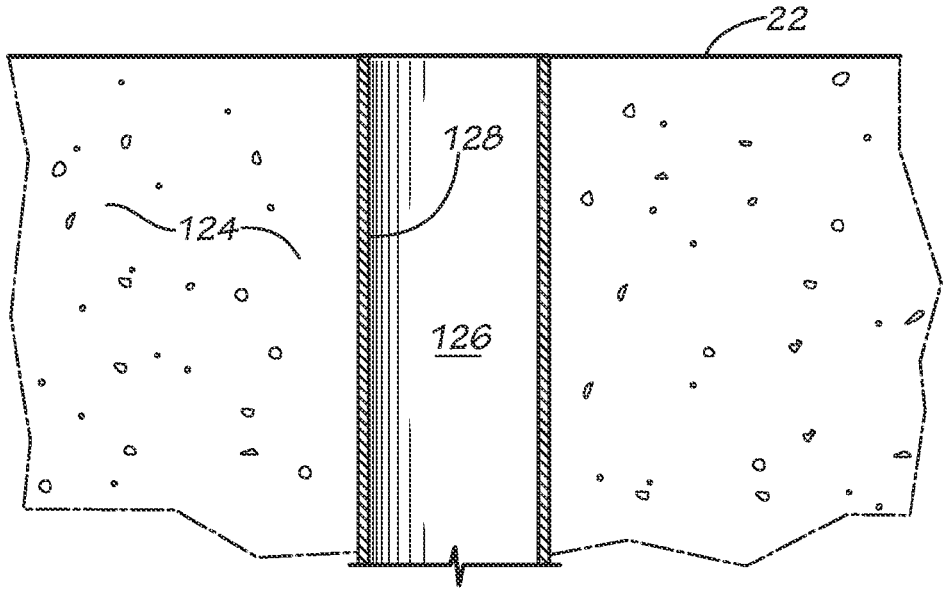
FIG. 4A is a diagram of the floor of a building shown in FIG. 1, according to various implementations.

FIG. 4A is a diagram showing an embodiment of the building floor 22 shown in FIG. 1. According to various implementations, the floor 22 may comprise concrete 124 having an opening 126 formed therein. One way that the opening 126 may be formed is by placing a foundation element 128 in the floor 22 as the concrete 124 is poured, thus preventing the concrete 124 from entering the opening 126. According to some embodiments, the foundation element 128 may be a PVC pipe having an inside diameter of 4 1/16 inch and a minimum length of about 12 inches. In some embodiments, the foundation element 128 may be aluminum. The foundation element 128 can also be referred to as a sleeve. When the concrete is set, the opening 126 may be configured to receive a post of the HLL system 10 while the foundation element 128 acts as an anchor for a post, which may have an outside diameter of about 4 inches and a 12 inch embedment. According to the implementations of the present disclosure, the opening 126 may also receive the post anchor extensions 24 and 80.

Figure 4B:
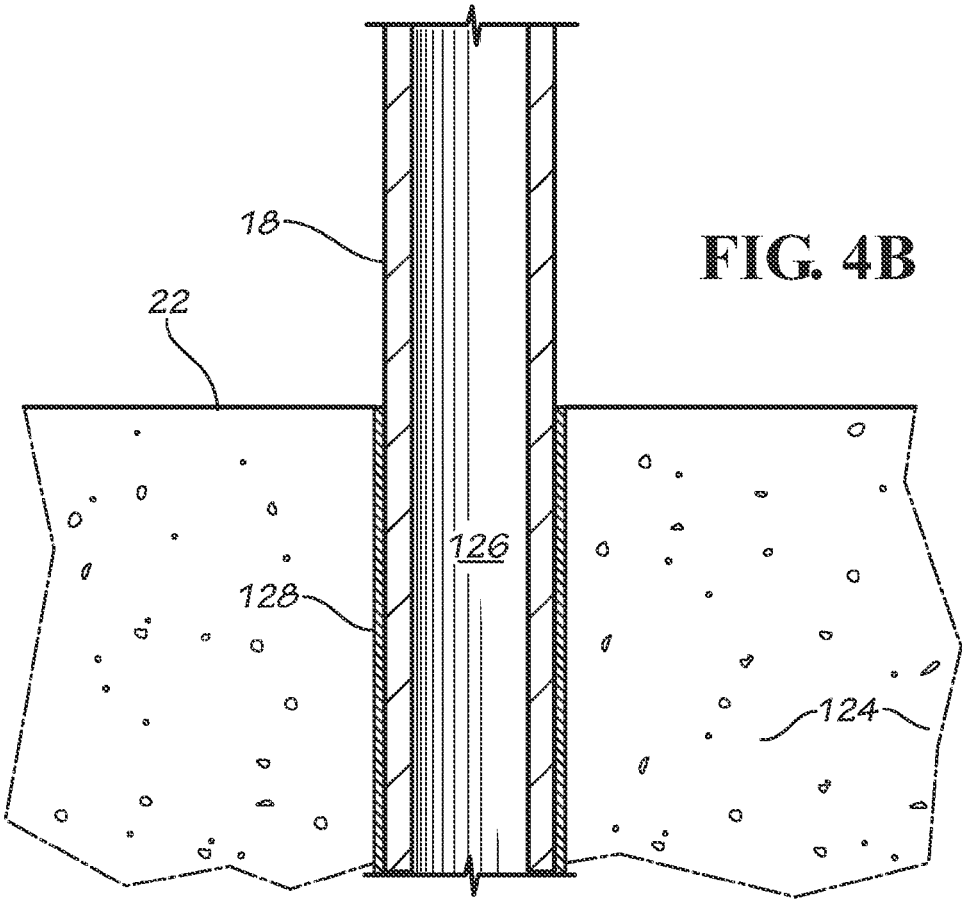
FIG. 4B is a diagram of the floor of FIG. 4A with a post inserted in an opening in the floor, according to various implementations.

FIG. 4B is a diagram showing the floor 22 of FIG. 4A with a conventional post 18. In this example, the post 18 is mounted directly within the opening 126 and supported by the foundation element 128. However, in this common arrangement, the height of the post 18 is not extended.

Figure 4C:
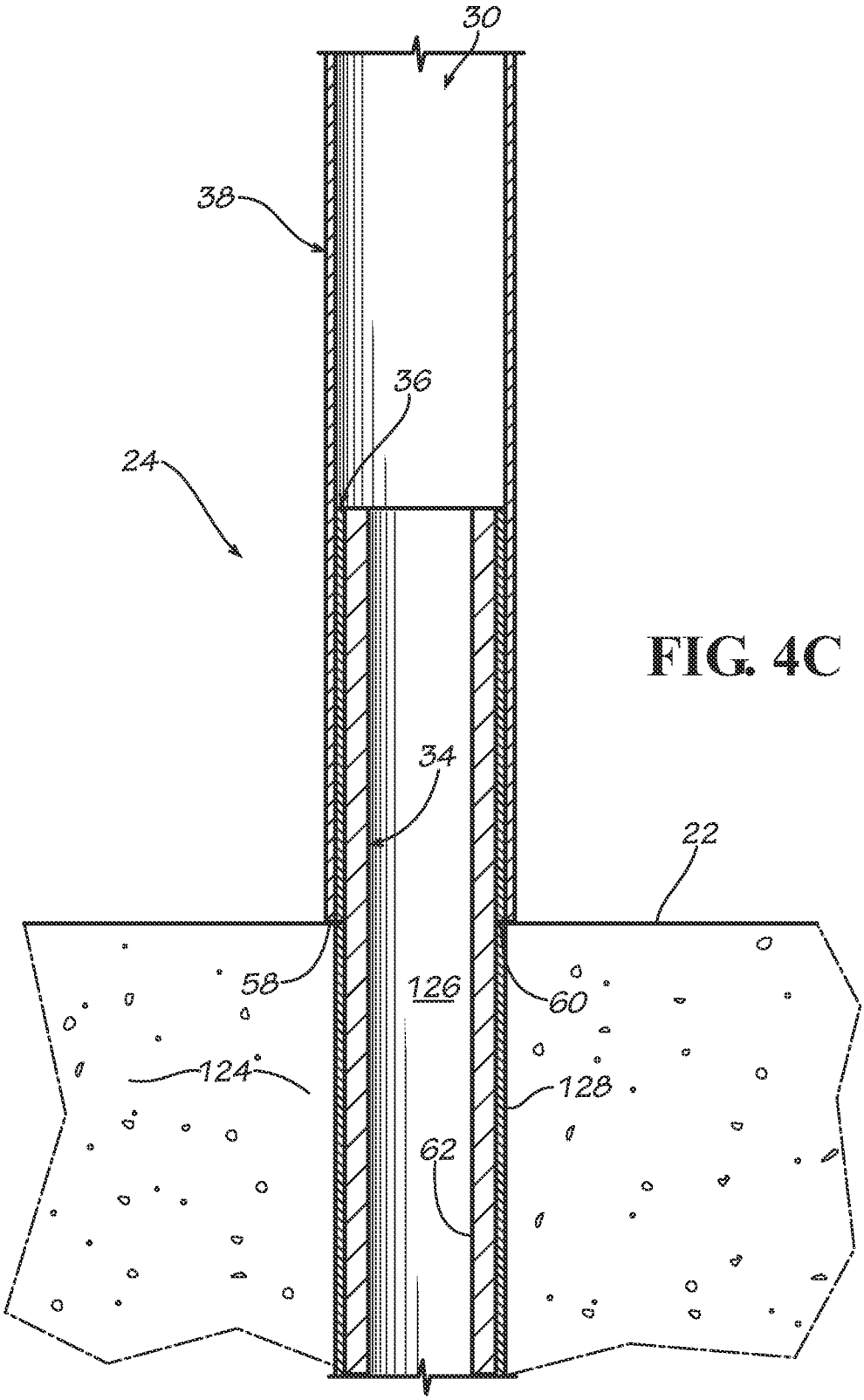
FIGS. 4C-4E are diagrams of the post anchor extension of FIG. 2 inserted in the floor, according to various implementations.

FIG. 4C is a diagram showing the floor 22 of FIG. 4A with the post anchor extension 24 of FIG. 2 inserted in the opening 126. According to various implementations, the post anchor extension 24 is mounted within the opening 126 and supported by the foundation element 128. Specifically, the bottom section 62 of the base component 34 of the post anchor extension 24 is inserted within the interior of the foundation element 128. The respective bottom ends 60, 58 of the spacer 36 and post sleeve 38 may sit on the surface of the floor 22 around the periphery of the opening 126. In some embodiments, the spacer 36 may be configured from the same material and have the same cross-sectional dimensions as the foundation element 128.

Figure 4D:
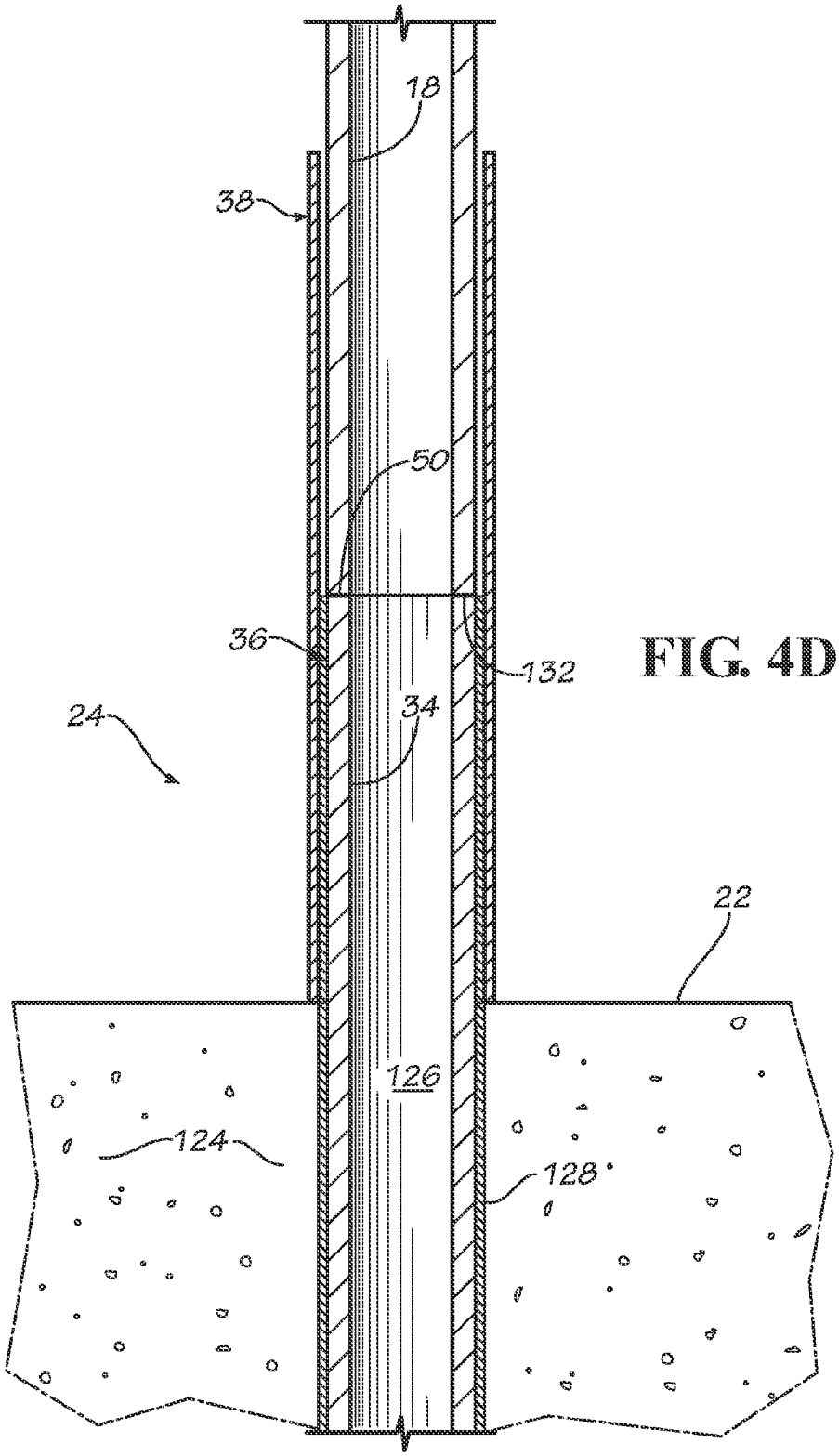

FIG. 4D shows the arrangement of FIG. 4C with the post anchor extension 24 inserted in the opening 126 and the post

18 inserted in the open end 30 of the post sleeve 38. In this configuration, a bottom end 132 of the post 18 rests on top of the top end 50 of the base component 34. Therefore, with the post anchor extension 24 in place, the height of the positioning of the post 18 when inserted in the post anchor extension 24 is increased by the length of the base component 34. In some embodiments, the post 18 may be fabricated to fit more tightly within the inside space formed by the inside surface of the post sleeve 38.

Figure 4E:
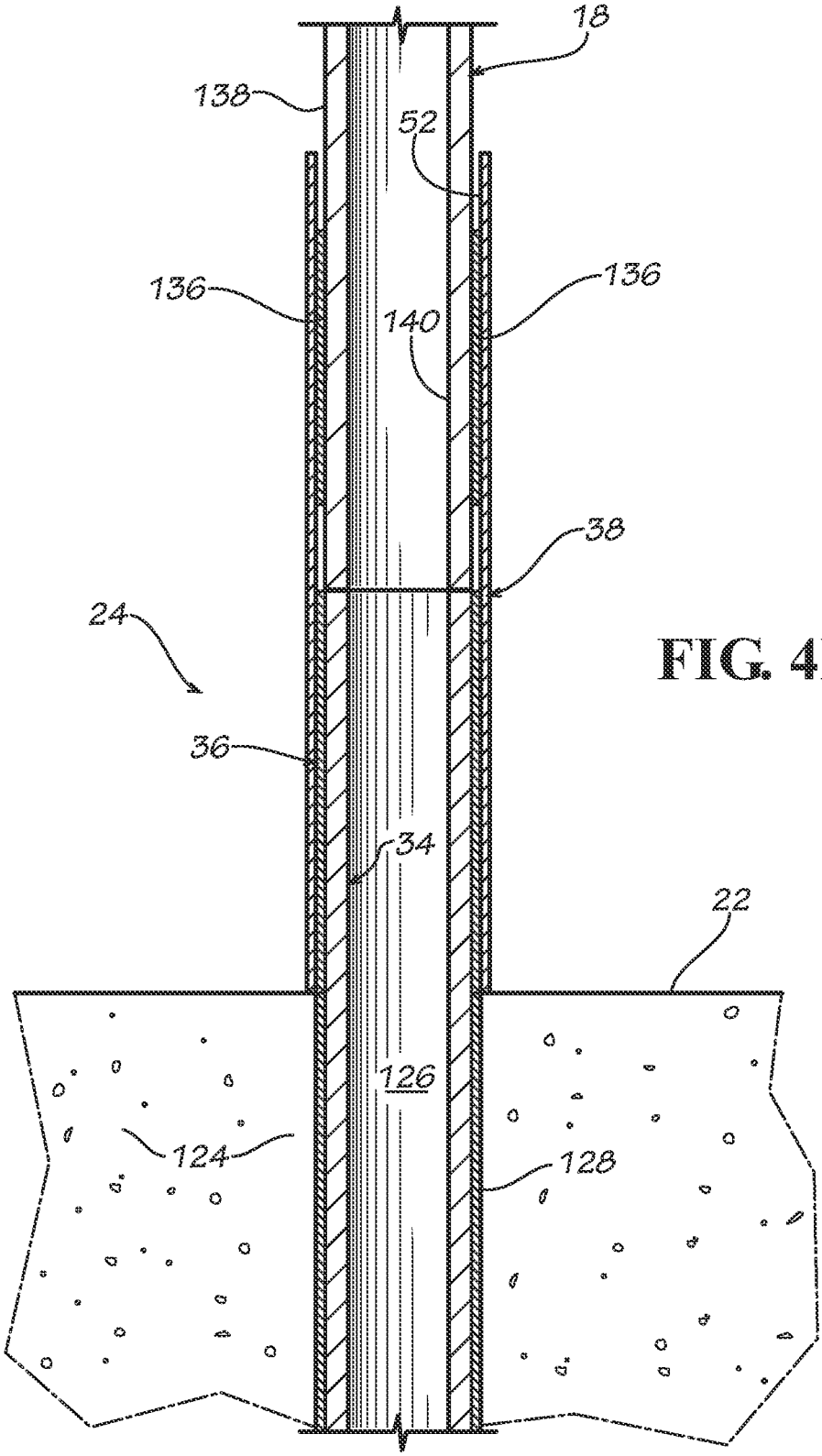

FIG. 4E is a diagram showing the arrangement of FIG. 4C with the post anchor extension 24 inserted in the opening 126 and the post 18 inserted in the open end 30 of the post sleeve 38. In addition, a collar element 136 is placed between the inside surface 52 of the post sleeve 38 and an outside surface 138 of the post 18. For example, the collar element 136 may be attached around a bottom portion 140 of the post 18 before it is inserted in the post anchor extension 24 or may be attached to the inside surface 52 of the post sleeve 38 before the post 18 is inserted. The collar 136 may be configured to provide stability to the post 18. According to some embodiments, the collar 136 may consist of the same material and have the same cross-sectional dimensions as the spacer 36 and/or the foundation element 128.

Figure 4F:
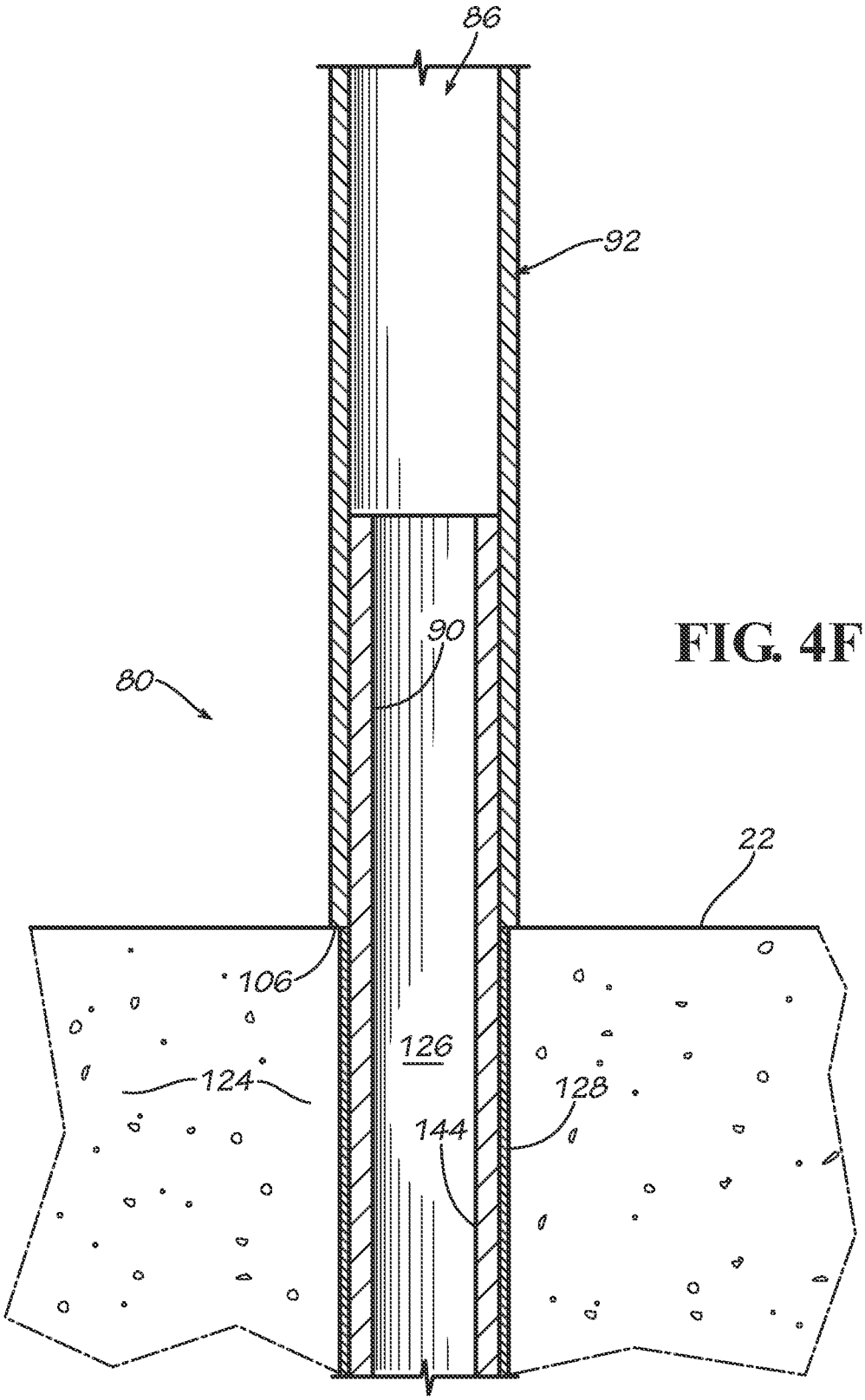
FIGS. 4F and 4G are diagrams of the post anchor extension of FIG. 3 inserted in the floor, according to various implementations.
Figure 4G:
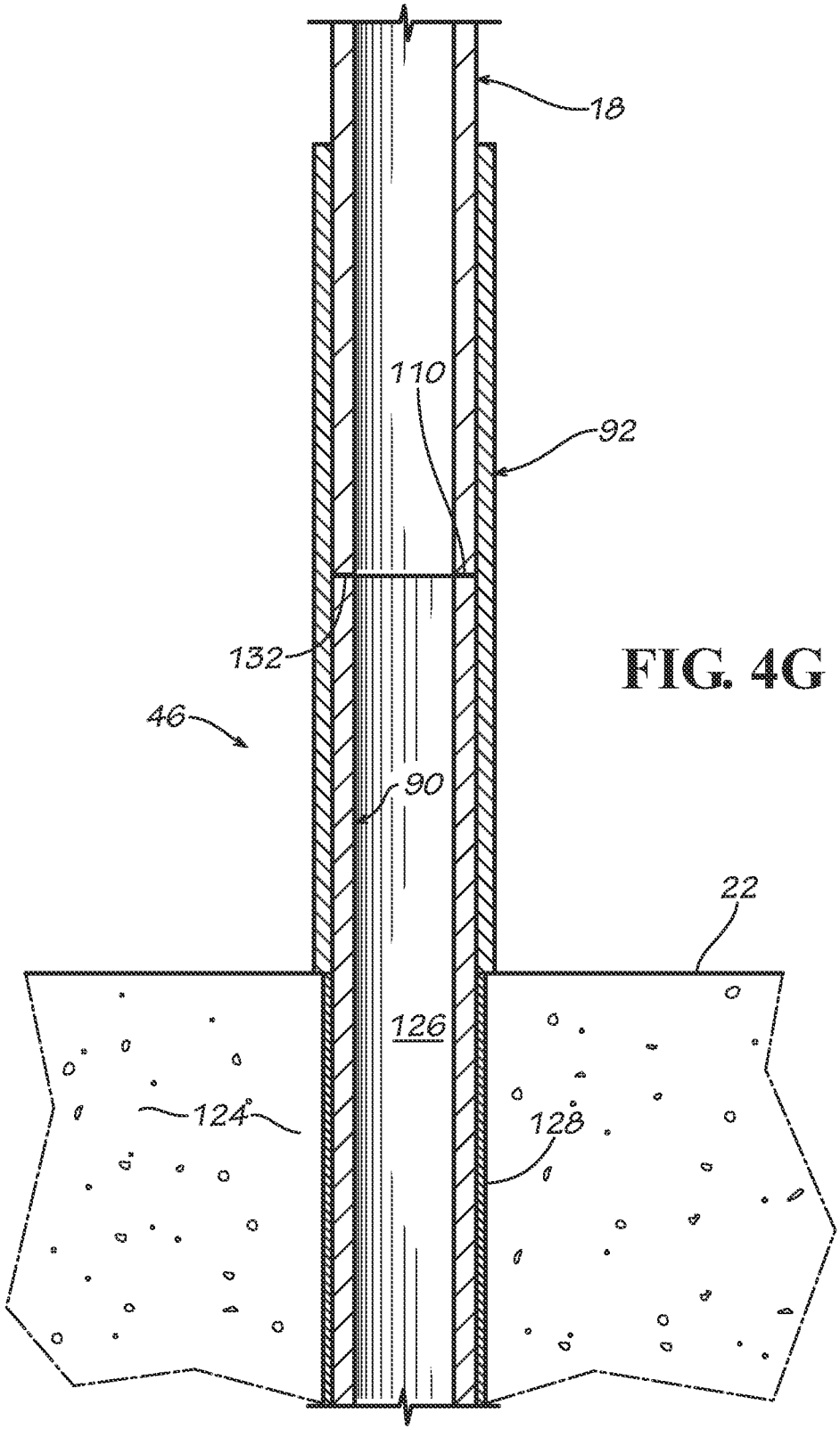

FIGS. 4F and 4G are diagrams illustrating the post anchor extension 80 of FIG. 3 inserted in the floor 22, according to various implementations. In this arrangement, a bottom section 144 of the base component 90 of the post anchor extension 80 is inserted in the opening 126 and supported by the foundation element 128. The bottom end 106 of the post sleeve 92 may rest on the top surface of the floor 22 around the periphery of the opening 126. When the post anchor extension 80 is secured by the foundation element 128, the post 18 may be inserted through the open end 86 of the post sleeve 92, as illustrated in FIG. 4G. The bottom end 132 of the post 18 may rest on the top end 110 of the base component 90. With this arrangement, the height of the positioning of the post 18 may be extended above its normal positioning by the length of the base component 90.

Figure 5A:
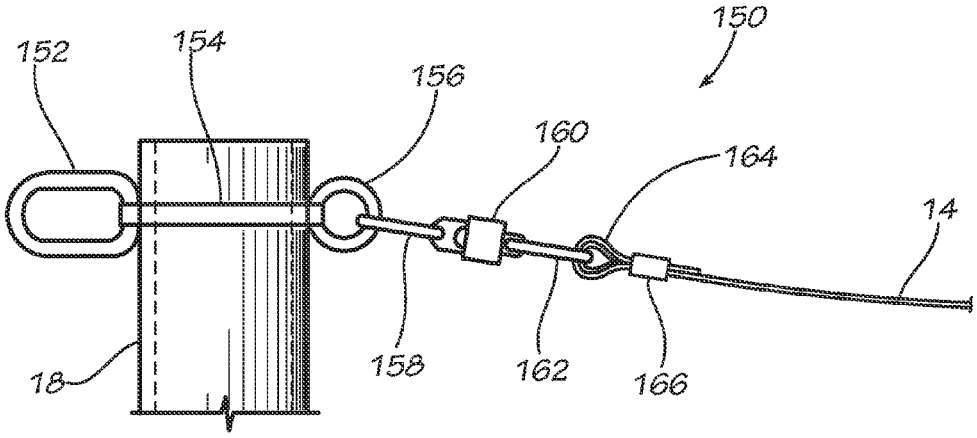
FIGS. 5A and 5B are diagrams of cable support systems, according to various implementations.
Figure 5B:
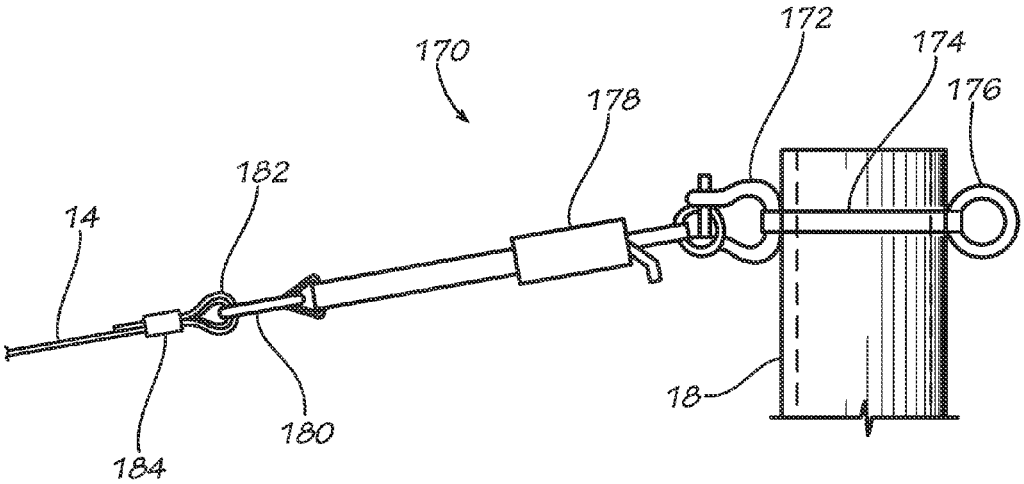

FIGS. 5A and 5B are diagrams showing various embodiments of cable support systems. A first embodiment of a cable support system 150 is shown in FIG. 5A. In this embodiment, the cable support system 150 includes a first shackle 152 attached by a bolt 154 running through a top section of the post 18 to an eye 156. The cable support system 150 also includes a second shackle 158, an inline energy absorber 160, a third shackle 162, and a thimble eye 164. The end of the cable 14 may be wrapped around the thimble eye 164 and swaged with a crimp element 166.

A second embodiment of a cable support system 170 is shown in FIG. 5B. In this embodiment, the cable support system 170 includes an eye 176 attached by a bolt 174 running through a top section of the post 18 to a screw-pin shackle 172. The cable support system 170 also includes a ratchet strap 178 between the screw-pin shackle 172 and a shackle 180 and thimble eye 182. Again, the cable 14 may be wrapped around the thimble eye 182 and swaged with a crimp element 184.

Figure 6A:
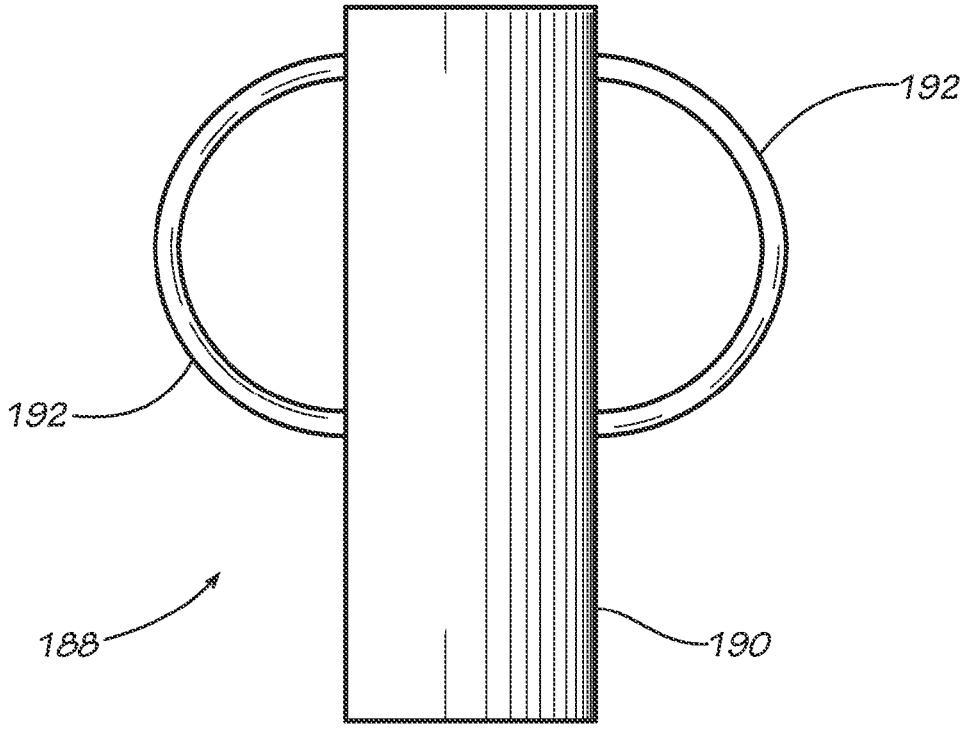
FIGS. 6A-6C are diagrams of a handle extension for the horizontal lifeline system of FIG. 1, according to various implementations.
Figure 6B:
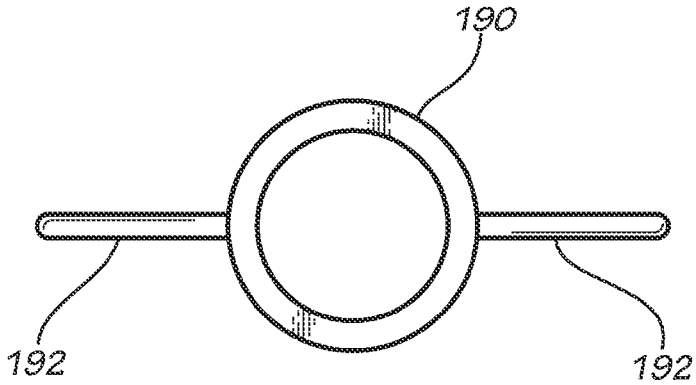
Figure 6C:
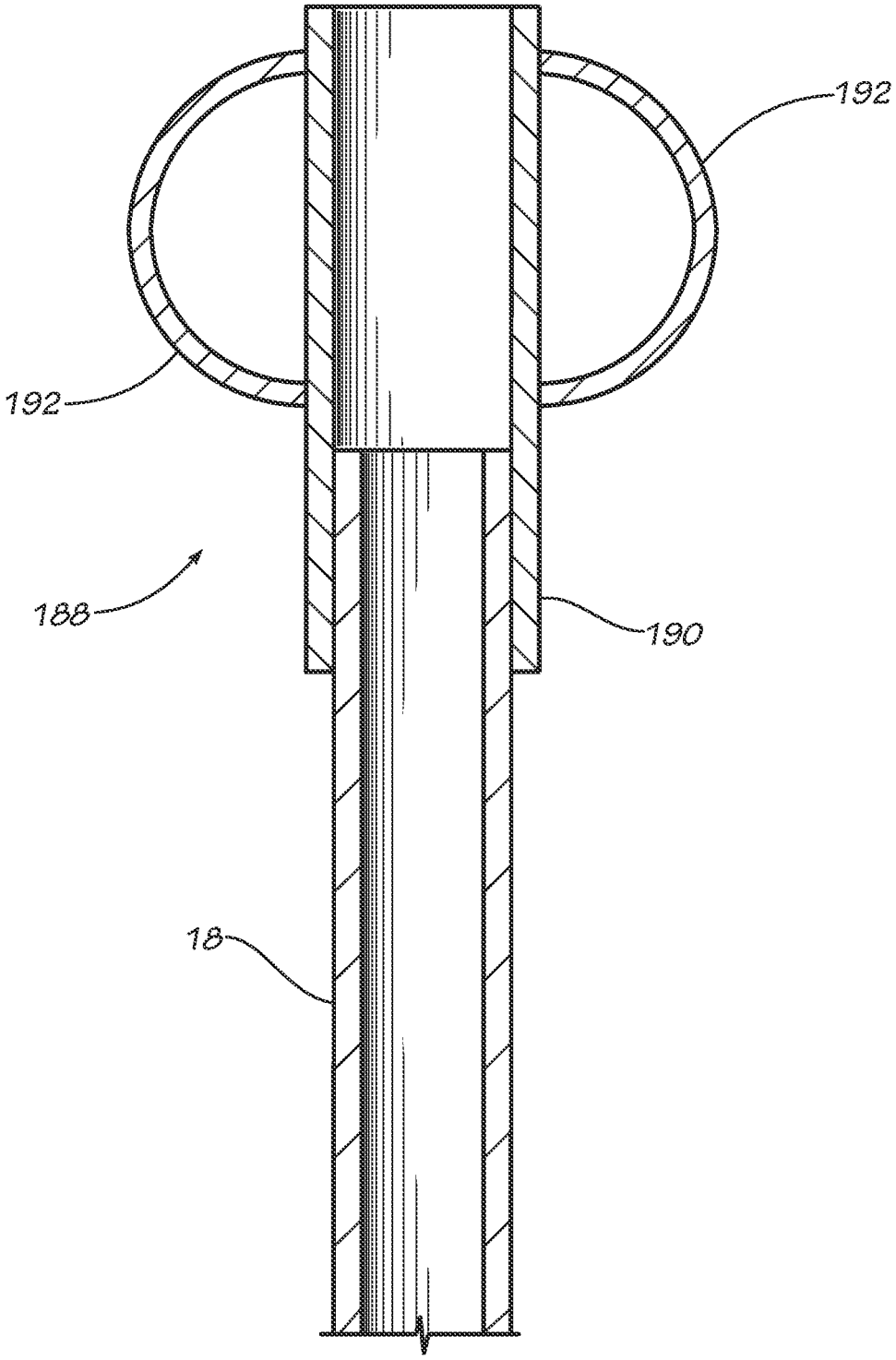

FIGS. 6A-6C are diagrams illustrating an embodiment of a handle extension 188 used with the horizontal lifeline system 10 of FIG. 1, according to various implementations. The handle extension 188 may be used as an alternative cable support system on a top end of the post 18 or may be placed on the top end of the post 18 above any other cable support systems attached to the post 18. FIG. 6A shows a side view of the handle extension 188; FIG. 6B shows a top view; and FIG. 6C shows a cut-away side view of the handle extension 188 connected to a top portion of the post 18.

In some embodiments, the handle extension 188 may include a pipe 190 and one or more handles 192. As illustrated, the handle extension 188 includes two handles 192, but in other embodiments, the handle extension 188 may be configured with only one handle 192 or at least three handles 192. The handles 192 may be constructed using rebar that is bent to form a half-circle (as illustrated) or shaped into any other desired pattern. The rebar, for example, may be #7 rebar (having a nominal diameter of ⅞ inch), #8 rebar (having a nominal diameter of one inch), or may have other predetermined sizes. The ends or end portions of the rebar may be welded to the pipe 190. The pipe 190 is configured to fit over the top of the post 18 and may be secured (e.g., by welding) to the post 18.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and subcombinations of all elements, features, and aspects discussed above. All such modifications and variations are intended to be included herein within the scope of the present disclosure, and all possible claims to individual aspects or combinations of elements or steps are intended to be supported by the present disclosure.

I claim:

1. A horizontal lifeline system comprising:

at least two stanchions, each stanchion having a post supported by a post anchor extension, each post anchor extension configured to extend a height of a position of the post;

a cable connected between the at least two stanchions; and a lifeline having a first end and a second end, wherein the first end is connected to a harness constructed for supporting a person, and the second is moveably linked to the cable;

wherein the post anchor extension comprises a base component and a post sleeve, the post sleeve defining a cavity occupied by a portion of the base component, and wherein the cavity is constructed for receiving a portion of the post, wherein the base component is configured to be positioned within a poured foundation of a structure, and a bottom section of the post sleeve is connected to an outside surface of a top section of the base component via a spacer, wherein an inside surface of the spacer is connected to an outside surface of the base component such that a top end of the spacer is even with a top end of the base component, and an inside surface of the post sleeve is connected to an outside surface of the spacer such that a bottom end of the post sleeve is even with a bottom end of the spacer, wherein the bottom end of the spacer and the bottom end of the post sleeve are welded to the outside surface of the top section of the base component using a tack weld applied to at least two locations along a periphery of the outside surface of the top section of the base component.

2. The horizontal lifeline system of claim 1, wherein the tack weld is formed around an entire periphery of the outside surface of the top section of the base component.

3. The horizontal lifeline system of claim 1, wherein the base component, spacer, and post sleeve are configured to be connected together using a bolt inserted through a plurality of holes in the base component, spacer, and post sleeve.

4. The horizontal lifeline system of claim 1, further comprising a first end stanchion of the at least two stanchions connected to a first end of the cable, a second end stanchion of the at least two stanchions connected to a second end of the cable, and at least one additional stanchion connected to an intermediate portion of the cable.

5. The horizontal lifeline system of claim 1, further comprising a collar positioned between a bottom portion of the post and the inside surface of the post sleeve, and wherein the base component and the post sleeve are cylindrical, and wherein the base component and the post sleeve are co-linear with respect to one another.

6. The horizontal lifeline system of claim 1, wherein the base component and the post sleeve are cylindrical, and wherein the base component and the post sleeve are co-linear with respect to one another.

7. A horizontal lifeline system comprising:

at least two stanchions, each stanchion having a post supported by a post anchor extension, each post anchor extension configured to extend a height of a position of the post;

a cable connected between the at least two stanchions; and a lifeline having a first end and a second end, wherein the first end is connected to a harness constructed for supporting a person, and the second is moveably linked to the cable;

wherein the post anchor extension comprises a base component and a post sleeve, the post sleeve defining a cavity occupied by a portion of the base component, and wherein the cavity is constructed for receiving a portion of the post, the post anchor extension further comprising a spacer configured to be connected between the base component and the post sleeve, wherein the base component, spacer, and post sleeve are welded together such that an inside surface of the spacer is connected to a portion of an outside surface of the base component and a portion of an inside surface of the post sleeve is connected to an outside surface of the spacer, wherein a top end of the spacer is even with a top end of the base component and a bottom end of the post sleeve is even with a bottom end of the spacer;

wherein the base component, spacer, and post sleeve are cylindrical pipes, the base component having an inside diameter of 2.728 inches and an outer diameter of 4.000 inches, the spacer having an inside diameter of 4.026 inches and an outer diameter of 4.500 inches, and the post sleeve pipe having an inside diameter of 4.506 inches and an outside diameter of 5.000 inches.

8. The horizontal lifeline system of claim 7, wherein the spacer is a polyvinyl chloride (PVC) pipe.

9. The horizontal lifeline system of claim 7, wherein the base component and the post sleeve are co-linear with respect to one another.

10. The horizontal lifeline system of claim 7, wherein the base component is a solid rod.

* * * * *